US011196176B2

(12) United States Patent
Zhao et al.

(10) Patent No.: US 11,196,176 B2
(45) Date of Patent: Dec. 7, 2021

(54) RADIATION ELEMENT, AS WELL AS ANTENNA UNIT AND ANTENNA ARRAY THEREOF

(71) Applicant: TONGYU COMMUNICATION INC., Zhongshan (CN)

(72) Inventors: Wei Zhao, Zhongshan (CN); Wenlan Wang, Zhongshan (CN); Zhonglin Wu, Zhongshan (CN); Zhuofeng Gao, Zhongshan (CN)

(73) Assignee: TONGYU COMMUNICATION INC., Zhongshan (CN)

( * ) Notice: Subject to any disclaimer, the term of this patent is extended or adjusted under 35 U.S.C. 154(b) by 0 days.

(21) Appl. No.: 16/346,960

(22) PCT Filed: May 17, 2017

(86) PCT No.: PCT/CN2017/084724
§ 371 (c)(1),
(2) Date: May 2, 2019

(87) PCT Pub. No.: WO2018/209600
PCT Pub. Date: Nov. 22, 2018

(65) Prior Publication Data

US 2020/0059008 A1 Feb. 20, 2020

(51) Int. Cl.

| | |
|---|---|
| ***H01Q 21/00*** | (2006.01) |
| ***H01Q 1/22*** | (2006.01) |
| ***H01Q 1/48*** | (2006.01) |
| ***H01Q 15/14*** | (2006.01) |

(52) U.S. Cl.
CPC ..... *H01Q 21/0025* (2013.01); *H01Q 1/22* (2013.01); *H01Q 1/48* (2013.01); *H01Q 15/14* (2013.01); *H01Q 21/0087* (2013.01)

(58) Field of Classification Search
CPC ..... H01Q 21/24; H01Q 21/26; H01Q 25/001; H01Q 21/0025; H01Q 1/22; H01Q 1/48; H01Q 15/14; H01Q 21/0087
See application file for complete search history.

(56) References Cited

U.S. PATENT DOCUMENTS

| | | | | |
|---|---|---|---|---|
| 2011/0128198 | A1* | 6/2011 | Ban | H01Q 9/285 343/718 |
| 2012/0280878 | A1* | 11/2012 | Timofeev | H01Q 21/08 343/793 |
| 2018/0294550 | A1* | 10/2018 | Segador Alvarez | H01Q 9/28 |
| 2019/0288406 | A1* | 9/2019 | Yang | H01Q 1/52 |
| 2019/0312338 | A1* | 10/2019 | Guntupalli | H01Q 1/38 |

FOREIGN PATENT DOCUMENTS

CN 203760641 U * 8/2014

* cited by examiner

*Primary Examiner* — Dieu Hien T Duong
(74) *Attorney, Agent, or Firm* — Oliff PLC

(57) ABSTRACT

A radiation element, as well as an antenna unit and an antenna array thereof. The radiation element includes a metal radiation sheet, a plastic support structure, and a feeding balun. The antenna unit further includes a feeding network. Laser Direct Structuring (LDS) technology is used to manufacture the radiation element, the antenna unit and the antenna array thereof, eliminating metal reflection sheets; further surface mount technology (SMT) is employed to weld the antenna unit and the feeding network together, the antenna being light-weight and simple to assemble.

15 Claims, 4 Drawing Sheets

RADIATION ELEMENT, AS WELL AS ANTENNA UNIT AND ANTENNA ARRAY THEREOF

BACKGROUND

Technical Field

The present invention relates to the technical field of mobile communication base stations, and particularly, to a novel radiation element, as well as an antenna unit and an antenna array thereof.

Related Art

Large-scale, light-weight antenna array design is the primary problem solved by a 5G communication technology. A conventional base station using metal die-casting array elements is heavy; a feeding network is processed with a Printed Circuit Board (PCB), and at the same time, in order to ensure that the structure of a large-scale antenna array is not deformed, a metal reflection sheet is required as a substrate of the PCB to improve the structural strength. However, the application of the metal reflection sheet increases the weight of the antenna array. How to reduce the weight of the antenna array elements and the overall weight of the antenna array and ensure the performance of the antenna is a technical problem that needs to be solved urgently.

SUMMARY

The present invention mainly aims to provide a novel radiation element for solving the problems of large weight, high cost, unfavorable installation, excessive weld points and the like of the conventional antenna unit.

The present invention further aims to provide a novel antenna unit for solving the problems of large weight, high cost, unfavorable installation, excessive weld points, unsuitable large-scale production and the like of the conventional antenna unit.

The present invention still further aims to provide a novel antenna array for solving the problems of large overall weight, high cost, unsuitable large-scale production and the like of the conventional antenna array.

Solutions of Problems

Technical Solutions

To achieve the main objective of the present invention, a radiation element is provided, comprising: a metal radiation sheet, a plastic support structure, and feeding baluns. The feeding baluns are metal feeding structures formed by applying Laser Direct Structuring (LDS) technology on the surface of the plastic support structure.

As an embodiment, the metal radiation sheet is mounted at the top of the plastic support structure by clamping.

As an embodiment, the top of the plastic support structure has card slot structures, the metal radiation sheet is provided with mounting holes, and the card slot structures are inserted into the mounting holes to fix the metal radiation sheet.

As an embodiment, the top end of the feeding structure extends outward to form a matching branch, the length and width of which are adapted to the working center frequency and standing waves of the antenna unit; and the bottom end of the feeding structure extends to form a pad.

As an embodiment, the card slot structure is an integrated bulge formed integrally with the plastic support structure; and the metal feeding structure is a metal layer, corresponding to and attached to the inner surface and two end faces of the plastic support structure.

As an embodiment, the plastic support structure is a hollow columnar structure; and the feeding baluns are metal feeding structures formed at the diagonals of the plastic support structure.

As an embodiment, four feeding baluns are provided and are respectively four metal feeding structures manufactured at four diagonals of the plastic support structure; and the metal feeding structures are the same.

As an embodiment, the plastic support structure is a hollow trapezoid structure; and four card slot structures and four mounting holes are provided.

The present invention further provides an antenna unit comprising a feeding network and the aforementioned radiation element, the feeding baluns being electrically connected to the feeding network.

As an embodiment, the antenna unit further comprises a plastic body for supporting the feeding network; the feeding network is formed on the upper surface of the plastic body by the LDS technology; and the radiation element is mounted on the plastic body.

As an embodiment, the feeding baluns are metal layers, and the feeding network is also a metal layer; and pads at the bottom ends of the feeding baluns are welded to the feeding network metal layer by a surface mounted technology (SMT).

As an embodiment, the feeding network is a power division network, comprising power dividers.

As an embodiment, the feeding network comprises two independent one-to-two power dividers; one of the power dividers is a +45° polarized feeding line, and the other power divider is −45° polarized feeding line.

As an embodiment, the phase difference between two output metal circuits of the −45° polarized feeding line is 180°; and the phase difference between two output metal circuits of the +45° polarized feeding line is 180°.

As an embodiment, the lower surface of the plastic body is a metal ground layer; and the plastic body and the metal ground layer on the lower surface thereof jointly constitute a reflection sheet of the antenna unit.

The present invention also provides an antenna array comprising a plurality of antenna units above, the plurality of antenna units being arranged in parallel at intervals to form sub-arrays.

Advantages of the Invention

Advantages

By adopting the above technical solutions, the present invention achieves the following technical effects:

The radiation unit manufactured on the plastic support structure by Laser Direct Structuring (LDS) technology has good plasticity, does not need to be welded, effectively reduces the loss, and is simple in structure and convenient to manufacture; the plastic support structure is light and can effectively lighten the antenna, the plastic can effectively reduce the cost, and the installation is convenient and application to a large-scale antenna array can be achieved.

Further, the top of the plastic support structure is fixed to the metal radiation sheet by clamping to avoid welding and effectively reduce the loss, and the structure is simple and the assembly is convenient.

Further, adjustable segment metal layers are formed at the top ends of the feeding baluns, and the required operating frequency and standing waves can be obtained by adjusting the length and width of the metal layers, so that the operation is simple, the practicability is strong and the structure is simple.

The antenna unit of the present invention uses the above-mentioned radiation element, accordingly, an antenna with light weight, simple structure, convenient manufacture and installation, reduced loss and reduced cost is obtained, and a large-scale antenna array can be formed.

Further, the feeding network of the present invention is formed on the upper surface of the plastic body by applying the LDS technology, thereby avoiding the use of a PCB and a metal reflection sheet of a conventional antenna, effectively reducing the weight, improving the structural strength, and achieving good plasticity.

Further, the baluns are welded to the feeding network by the surface mount technology (SMT), so that the antenna is light in weight, easy to assemble and low in cost.

The antenna array of the present invention uses the above antenna unit and eliminate metal reflection sheets, and the antenna unit and the feeding network are welded together by the SMT to reduce the weight of the antenna array and improve the integration; and the large-scale antenna array with simple structure, simple assembly and effectively reduced cost is obtained.

The above technical features, as well as other features, objectives and advantages of the present invention, will be described in conjunction with various embodiments and the accompanying drawings of the present invention. However, the illustrative embodiments disclosed are merely examples, and are not intended to limit the scope of the present invention.

DETAILED DESCRIPTION

Figure 1:
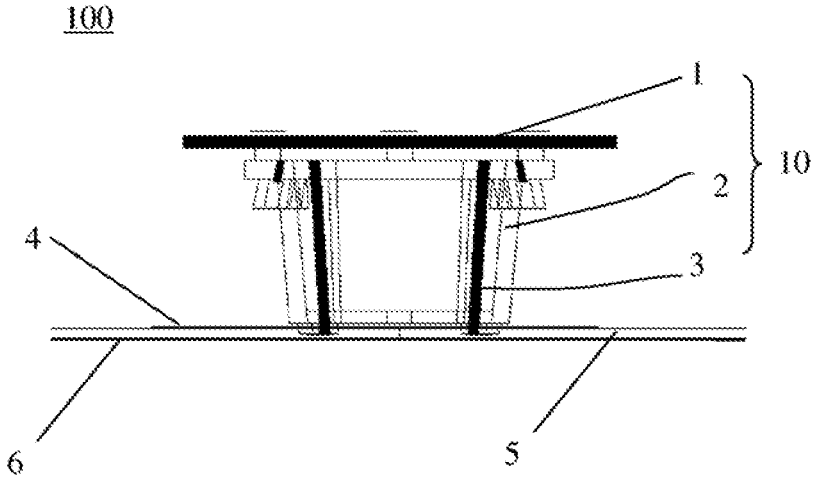
FIG. 1 is a side view of an antenna unit according to the present invention.
Figure 2:
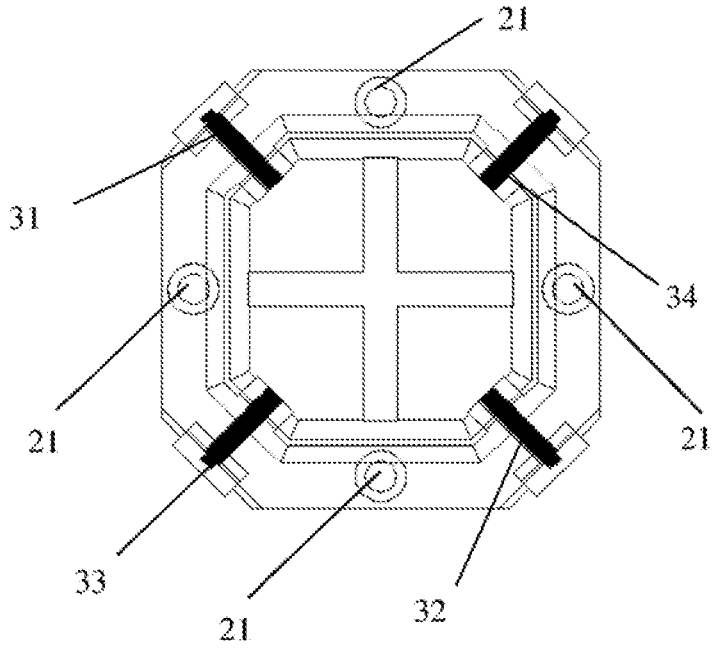
FIG. 2 is a top plan view of a radiation element according to the present invention.
Figure 3:
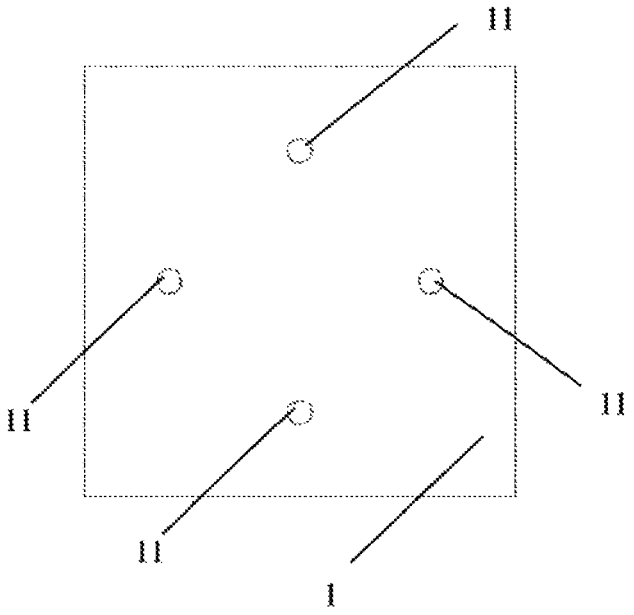
FIG. 3 is a schematic diagram of a metal radiation sheet of the antenna unit according to the present invention.
Figure 4:
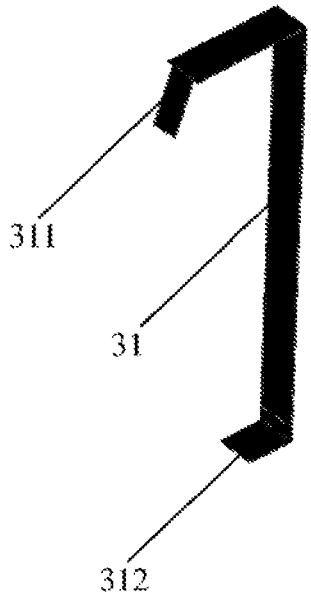
FIG. 4 is a schematic diagram of a feeding balun of the antenna unit according to the present invention.

The drawings provided by the present invention and the following descriptions of some embodiments are not intended to limit the present invention within these embodiments, but are provided for those skilled in the art to implement the present invention.

In a specific embodiment, referring to FIGS. 1 to 4, an antenna unit provided includes a radiation element 10 and a feeding network 4 at the bottom of the radiation element 10, and further includes a plastic body 5. The feeding network 4 is formed on the upper surface of the plastic body 5 by Laser Direct Structuring (LDS) technology. The radiation element 10 is mounted on the plastic body 5.

The radiation element 10 includes a metal radiation sheet 1, a plastic support structure 2, and feeding baluns 3 on the top, the feeding baluns 3 being metal feeding structures formed by applying the LDS technology on the surface of the plastic support structure. The feeding balun 3 is also a feeding line, as an example, a metal layer.

The metal radiation sheet 1 is mounted at the top of the plastic support structure 2 by clamping. In a specific embodiment, the metal radiation sheet 1 is fixed to the top of the plastic support structure 2 through card slots 21 at the top end of the plastic support structure 2, while the tops of the feeding baluns 3 are coupled to the metal radiation sheet 1. In the present embodiment, the clamping fixation of the top of the plastic support structure 2 to the metal radiation sheet 1 replaces welding to couple the feeding balun 3 to the metal radiation sheet 1, so as to avoid forming weld points to cause signal loss.

Specifically, a plurality of card slot structures 21 (shown in FIG. 2) are formed at the top of the plastic support structure 2, the metal radiation sheet 1 is correspondingly provided with a plurality of mounting holes 11 (shown in FIG. 3), and the card slot structures 21 are inserted into the mounting holes 11 to fix the metal radiation sheet 1. As an embodiment, the card slot structures 21 are bulges formed by being integrated with the plastic support structure 2, and extend upward. Preferably, the card slot structures 21 and the plastic support structure 2 are of an integrated indivisible structure.

The plastic support structure 2 is a hollow cylinder. In the present embodiment, the plastic support structure 2 is a trapezoid structure, having four card slot structures 21 at the top for fixing the metal radiation sheet 1 with the corresponding four mounting holes 11 of the metal radiation sheet 1.

Referring to FIG. 4 again, the unit feeding balun 3 according to one embodiment of the present invention is a metal feeding structure formed on the surface of the plastic support structure 2 by the LDS technology. In an embodiment, the unit feeding balun 3 is a metal layer attached to the surface of the plastic support structure 2. The top end of the feeding structure or the feeding balun 3 extends outward to form a matching branch 311, the length and width of which are adapted to the working center frequency and standing waves of the antenna unit. The working center frequency of the antenna unit and the standing waves are obtained by adjusting the shape of the matching branch 311, which is convenient for operation and implementation.

The bottom end of the feeding structure or the feeding balun 3 extends to form a pad 312 welded to the feeding network 4. In an embodiment, the top end of the feeding structure or the feeding balun 3 further includes a horizontal coupling segment metal layer, which is located on the top surface of the plastic support structure 2 and coupled to the metal radiation sheet 1 by signals. The adjustable matching branch 311 extends outward from the coupling segment. As an embodiment, the pad 312 is a metal layer attached to the bottom end surface of the support structure 2 to facilitate contact with the feeding network 4 at the bottom.

In the present embodiment, four metal feeding structures (respectively numbered 31, 32, 33, 34 for distinguishing) are manufactured on the surface corresponding to the diagonals of the plastic support structure 2 by applying the LDS technology. As an embodiment, the metal feeding structures have the same size.

The metal feeding structure 31 is welded to the feeding network metal layer 4 by applying the SMT through the pad 312 formed by the bottom metal layer.

The standing waves of the antenna unit are adjusted and optimized by adjusting the width of the metal layer of the matching branch 311 of the metal feeding structure 31.

Figure 5:
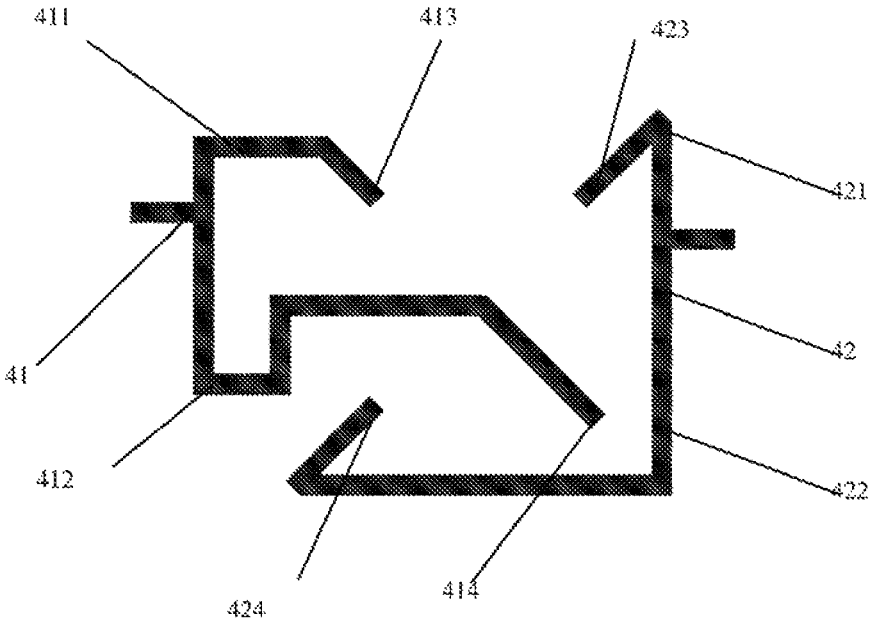
FIG. 5 is a circuit schematic diagram of a feeding network of the antenna unit according to the present invention.

Referring to FIG. 5, the unit feeding network line 4 provided by the present invention is a power division network, including power dividers. In the present embodiment, the unit feeding network 4 is composed of two independent one-to-two power dividers 41 and 42, the one-to-two power divider 41 is a +45° polarized feeding line, and the one-to-two power divider 42 is a −45° polarized feeding line.

The phase difference between two metal circuits 421 and 422 of the −45° polarized feeding line is 180°. The phase difference between two metal circuits 411 and 412 of the +45° polarized feeding line is 180°. The ends 413, 414, 423 and 424 of the metal circuits are respectively welded to the bottom end pads 312 of the unit feeding baluns 3, thereby realizing signal transmission of an antenna oscillator.

The feeding network 4 is manufactured on the upper surface of the feeding plastic body 5 by applying the LDS technology, the lower surface of the feeding plastic body 5 is a metal ground layer 6, and the two function as a conventional metal reflection sheet, with much lower mass and cost.

Figure 6:
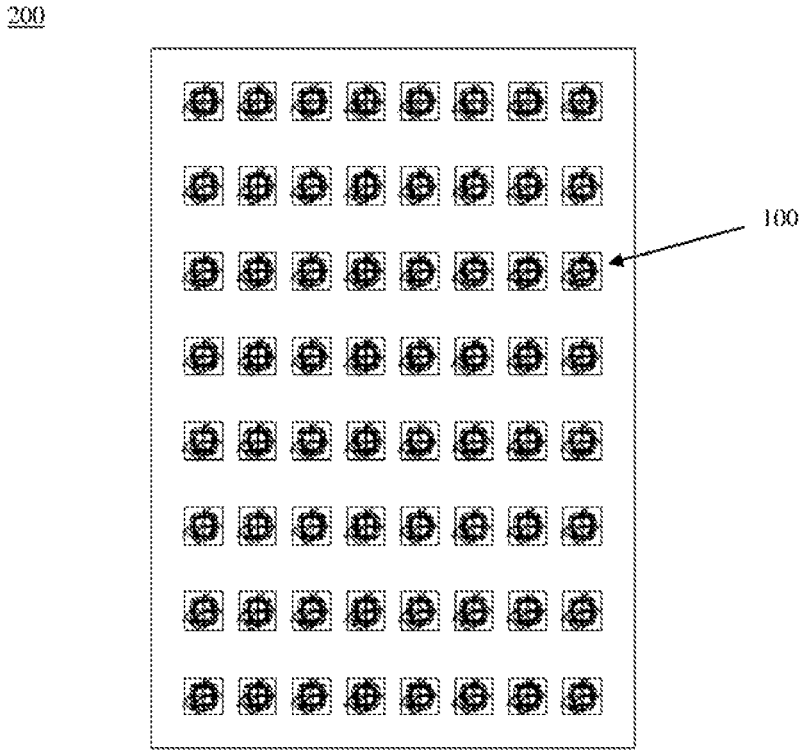
FIG. 6 is a structure schematic diagram of an antenna array according to the present invention.

Referring to FIG. 6, an embodiment of the present invention provides an antenna array 200, including a plurality of antenna units 100 according to any one of the above embodiments, the antenna units 100 being arranged in parallel at intervals to form sub-arrays.

In the above embodiment of the present invention, the antenna units and the feeding networks are manufactured by applying the Laser Direct Structuring (LDS) technology to eliminate metal reflection sheets and reduce the overall weight of the antenna array.

The LDS technology is a technology that uses laser to irradiate a digitized pattern onto the surface of a polymer material, and directly metallizes the irradiated area to form a pattern on the surface of the polymer material. A metallized pattern can be formed on a polymer shell. The power division networks of the antenna array and the feeding lines of the antenna units are manufactured on the surface of the polymer material (plastic in the specific embodiment) by applying the LDS technology to reduce the weight of the antenna array and improve the integration.

The antenna array of the present invention eliminates metal reflection sheets, and the antenna units and the feeding networks are welded together by the surface mounted technology (SMT), so that the antenna is light in weight and easy to assemble.

The examples and drawings shown here are for illustrative descriptions only but not for limitation, and the present invention can realize the specific embodiments. Other embodiments may be utilized or derived in order that structural and logical substitutions and changes are made without departing from the scope of the present invention. These embodiments of the protected subject matter of the present invention are separately or jointly referred to as "the present invention" only for simplicity, and do not subjectively define the scope of the present application to any single invention or inventive concept if more than one invention is disclosed. Therefore, although the specific embodiments are disclosed herein, the shown specific embodiments may be substituted by any solution for achieving the same purpose. This description is intended to cover any and all adaptations or variation modes of various embodiments. Combinations of the above-mentioned embodiments, as well as other embodiments not specifically described, will be apparent to those skilled in the art based on the above description.

What is claimed is:

1. A radiation element in an antenna unit, the radiation element comprising:

a plastic support structure;

a metal radiation sheet that is mounted on a top surface of the plastic support structure without welding, and that covers a hollow center of the plastic support structure; and feeding baluns which are metal feeding structures formed by applying Laser Direct Structuring (LDS) technology on a surface of the plastic support structure, wherein:

the feeding baluns are coupled to the metal radiation sheet without welding, the top surface of the plastic support structure has card slot structures which are plastic bulges formed by being integrated with the plastic support structure and which extend upward, the metal radiation sheet is provided with mounting holes, and the card slot structures are inserted into the mounting holes to fix the metal radiation sheet on the top surface of the plastic support structure without welding.

2. The radiation element according to claim 1, wherein the metal radiation sheet is mounted on the top surface of the plastic support structure by clamping without welding.

3. The radiation element according to claim 1, wherein:

a top end of the feeding structure, which is formed on a top end surface of the plastic support structure on an opposite side of the top surface, extends outward to form a matching branch; and a length and a width of the matching branch are adjustable to adjust a working center frequency and standing waves of the antenna unit; and a bottom end of the feeding structure extends to form a pad.

4. The radiation element according to claim 1, wherein each of the metal feeding structures is a metal layer attached to an inner surface and two end faces of the plastic support structure.

5. The radiation element according to claim 1, wherein the plastic support structure is a hollow columnar structure; and the feeding baluns are metal feeding structures formed at diagonals of the plastic support structure.

6. The radiation element according to claim 5, wherein four feeding baluns are provided and are respectively four metal feeding structures manufactured at four diagonals of the plastic support structure; and the four metal feeding structures are the same.

7. The radiation element according to claim 5, wherein the plastic support structure is a hollow trapezoid structure; and four card slot structures are provided on the top surface of the plastic support structure, and four corresponding mounting holes are provided on the metal radiation sheet.

8. The antenna unit, comprising a feeding network; and the radiation element according to claim 1, wherein the feeding baluns are electrically connected to the feeding network.

9. The antenna unit according to claim 8, wherein the antenna unit further comprises:

a plastic body for supporting the feeding network;

the feeding network is formed on an upper surface of the plastic body by the LDS technology; and the radiation element of claim 1 is mounted on the plastic body.

10. The antenna unit according to claim 9, wherein a lower surface of the plastic body is a metal ground layer; and the plastic body and the metal ground layer on the lower surface thereof jointly constitute a reflection sheet of the antenna unit.

11. The antenna unit according to claim 8, wherein the feeding baluns are metal layers, and the feeding network is also a metal layer; and pads at bottom ends of the feeding baluns are welded to the feeding network metal layer by SMT technology.

12. The antenna unit according to claim 8, wherein the feeding network is a power division network, comprising power dividers.

13. The antenna unit according to claim 12, wherein the feeding network comprises two independent one-to-two power dividers;

one of the power dividers is a +45° polarized feeding line; and the other power divider is a −45° polarized feeding line.

14. The antenna unit according to claim 13, wherein a phase difference between two output metal circuits of the −45° polarized feeding line is 180°; and a phase difference between two output metal circuits of the +45° polarized feeding line is 180°.

15. An antenna array comprising a plurality of antenna units each being the antenna unit according to claim 8, the plurality of antenna units being arranged in parallel at intervals to form sub-arrays.

* * * * *